US007241191B2

(12) United States Patent
Ecker et al.

(10) Patent No.: US 7,241,191 B2
(45) Date of Patent: Jul. 10, 2007

(54) CURRENT BRIDGE

(75) Inventors: Stefan Ecker, Vilsbiburg (DE); Stefan Wimmer, Hohenthann (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 0 days.

(21) Appl. No.: 11/268,676

(22) Filed: Nov. 7, 2005

(65) Prior Publication Data

US 2006/0132279 A1 Jun. 22, 2006

(30) Foreign Application Priority Data

Nov. 5, 2004 (DE) ..... 10 2004 053 577

(51) Int. Cl.
*H01R 9/24* (2006.01)

(52) U.S. Cl. ..... 439/885; 439/512

(58) Field of Classification Search ..... 439/885, 439/512, 507, 510, 511, 513, 733.1
See application file for complete search history.

(56) References Cited

U.S. PATENT DOCUMENTS

| | | | | |
|---|---|---|---|---|
| 3,955,877 | A * | 5/1976 | Cobaugh et al. | 439/853 |
| 4,775,336 | A * | 10/1988 | Paulo | 439/830 |
| 5,060,372 | A * | 10/1991 | Capp et al. | 29/883 |
| 5,417,589 | A * | 5/1995 | Terada | 439/590 |
| 6,231,406 | B1 * | 5/2001 | Lin et al. | 439/885 |
| 6,755,677 | B2 * | 6/2004 | Kamiya | 439/381 |
| 6,764,357 | B2 * | 7/2004 | Wu et al. | 439/885 |
| 2003/0022529 | A1 * | 1/2003 | Phillips et al. | 439/49 |
| 2004/0067698 | A1 * | 4/2004 | Lee | 439/885 |

* cited by examiner

*Primary Examiner*—Gary F. Paumen
(74) *Attorney, Agent, or Firm*—Wolf, Greenfield & Sacks

(57) ABSTRACT

A current bridge comprising an oblong support strip that has an end face, and a plurality of contact feet each having a first strip-shaped leg and a second strip-shaped leg. The contact feet extend from the end face of the support strip and are formed integrally with the support strip. The two legs each comprise a main face specified by their strip shape. The main faces of the two legs extend essentially parallel to one another.

13 Claims, 2 Drawing Sheets

DETAIL A

DETAIL C

CURRENT BRIDGE

BACKGROUND OF INVENTION

1. Field of Invention

Aspects of the invention relate to sheet-metal current bridges, and particularly to current bridges for use in automotive applications.

2. Discussion of Related Art

Current bridges are used in a variety of technical fields to provide electrical connection that can be established and interrupted rapidly and reliably. Some current bridges have contact feet that cooperate with mating components. Current bridges are used in some applications, such as automotive applications, to receive vehicle fuses. In such applications, current bridges can be introduced into and interlocked into a housing. Fuses can then be inserted into the housing and to be brought into conductive contact with the current bridges.

There is a general need for miniaturization of components in the automotive industry, and in other industrial sectors. However, arbitrary miniaturization of components, like current bridges, can cause problems for production costs, heat conduction through current bridges, and for economical use of materials.

Current bridges described in DE 203 15 160 have contact feet that comprise an abutment leg and a spring leg. The current bridge that is disclosed in this publication, however, has main faces formed by the abutment leg and the spring leg that are perpendicular relative to one another.

SUMMARY OF INVENTION

According to one aspect of the invention, a current bridge made sheet-metal is disclosed. The current bridge comprises an oblong support strip that has an end face. The current bridge also comprises a plurality of contact feet, each having a first strip-shaped leg and a second strip-shaped leg. At least one of the first and second legs is a spring leg. The contact feet extend away from the end face of the support strip and are formed integrally with the support strip. The first and second legs of each of the plurality of feet have a main face specified by their strip shape and extend essentially parallel to one another.

According to another aspect of the invention, a conductive current bridge is disclosed. The current bridge comprises a support strip that extends along a longitudinal axis. The current bridge also comprises a plurality of contact feet that extend away from the support strip. Each of the contact feet has a first leg and a second leg arranged substantially parallel to one another and include opposed contact faces formed from a common face of said sheet metal.

According to yet another aspect, a method for forming a current bridge from sheet metal is disclosed. The sheet metal has first and second planar faces. The method comprises punching a blank from the sheet metal and forming the blank into a support strip. The method also comprises forming contact feet that extend from the support strip and forming first and second legs of each of the contact feet. The first and second legs have opposed surfaces adapted to contact a mating component. The opposed surfaces are formed from the first planar face.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 4:
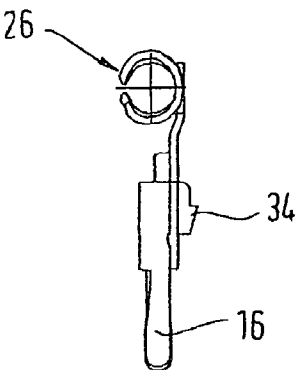
FIG. 4 is a side view of the current bridge of FIG. 1.

In one aspect of the invention, a current bridge addresses the shortcomings of the prior art with contact feet arranged along the longitudinal axis of the support strip that are reduced with respect to prior art current bridges without giving up the advantages of cost-effective production, adequate heat conduction and the economical use of materials.

Embodiments of the invention may have two legs of the contact feet aligned in such a manner that their main extension direction runs perpendicular to the longitudinal extension of the support strip. This may reduce the extent to which the contact feet are formed by the two legs in the longitudinal extension of the support material.

Embodiments include current bridges formed of sheet metal that comprise an oblong support strip with an end face. The current bridges may further comprise contact feet each having a first strip-shaped leg and a second strip-shaped leg. At least one of legs may be a spring leg. The contact feet may extend from the end face of the support strip and be formed integrally with the strip. The two legs of the contact feet can be formed in the shape of a strip. The legs may each have two opposed main faces that are dimensioned to be larger than the thickness of the leg. The main faces of the two legs can be arranged substantially parallel to one another (that is, the main face(s) of the first leg may be parallel to the main face(s) of the second leg). The contact feet may be designated with a single leg being a spring contact, or with both legs being spring contacts, as the present invention is not limited in this respect. The contact feet may be used to engage with, for example, Form C (DIN 72581-3) or Form F type flat fuses and to effect an electrical connection. The contact feet may be formed so as to engage other types of mating components, as desired, as the present invention is not limited in this respect. The main faces of the two legs of the contact feet can be arranged to extend in a direction that is essentially perpendicular to the longitudinal axis of the support strip to reduce the width of the contact feet along the longitudinal axis. This may make it possible to design contact chambers that are smaller within a housing that receives the current bridge. Also, this may allow the miniaturization of the current bridge and the associated housings.

In an illustrative embodiment, the support strip has a meandering shape when viewed from the end face. Here, the support strip forms first portions that extend essentially in the longitudinal axis of the support strip and second portions that extend essentially perpendicular to the longitudinal axis. In this regard, the term "essentially" is used to describe a zigzag or wavy configuration as well as a configuration with corners formed at right angles. The support strip may have a meandering shape not only when viewed from above, but also in its cross-section, i.e. across the entire height between the end face and an opposite end face. Current bridges with such a meandering cross-section may be designed so that the portion that connects the contact feet to the support strip has a dimension that prevents the contact feet from easily twisting or breaking off, even when the main faces of the two legs of a contact foot are aligned in parallel with one another. The dimension can also be designed such that, even when high currents pass through, the connecting portion does not fuse and adequate heat conduction is ensured. Also, the meandering course can allow the current bridge to be designed as a stamped part, which can be beneficial in terms of manufacturing and for reasons of cost. Although a meandering shape may be employed, the present invention is not limited in this respect.

In some embodiments, the first leg and the second leg are connected together by way of a connecting portion. In one embodiment, the first leg, as a result of the meandering shape is connected to at least a part of a second portion and the connecting portion is connected to at least part of a first portion. Such a design can allow the connection between the contact feet to the support strip such to have a sufficiently large dimension.

In one aspect, the free spring length of the spring leg and hence its resilience may be adjustable via the connecting portion. In this way, the resilience can be increased by extending the connecting portion further away from the first portion of the support strip. In other words, the further the connecting portion extends towards the end the spring leg, the shorter the free spring length and the higher the resilience.

In some embodiments, the first leg is an abutment leg and the second leg is a spring leg. Still, in some embodiments, the first leg may be a spring leg and the second leg an abutment leg. In still other embodiments, both legs, i.e. the first leg and the second leg, are each a spring leg, as the present invention is not limited in this regard.

In one embodiment, a catch is provided at one end of a second portion of the current bridge, such as a catch lug, which may enable the current bridge to catch within a housing. The catch may be formed integrally with the support strip. In one embodiment, the catch is provided at one end only of the oblong support strip. It should be appreciated that a catch need not be employed, as other suitable arrangements, or none at all, may be used to hold the current bridge within a housing.

In some embodiments, cost and manufacturing may make it preferable for the current bridge to have a geometry that can be traced back to a planar stamped part. The planar stamped part can then be bent into the desired geometry.

In one embodiment, the two legs of the contact feet are each arranged in relation to one another such that the main faces of those regions which represent the two legs within the underlying raw part face towards each other.

In one embodiment, the two legs of the contact feet can be formed together integrally. In one embodiment, the sheet metal can have a bend of 180° between the two legs such that the contact feet are U-shaped. In other words, the first leg, the connecting portion and the second leg, which form the contact foot, can describe an angle of 180° and be U-shaped.

A crimp portion can also be formed integrally with the support strip on an end face that is opposite to the end face of the support strip. The projection can be designed such that a lead with cross-section between 4 $mm^2$ and 6 $mm^2$ can be fixed thereto.

Figure 1:
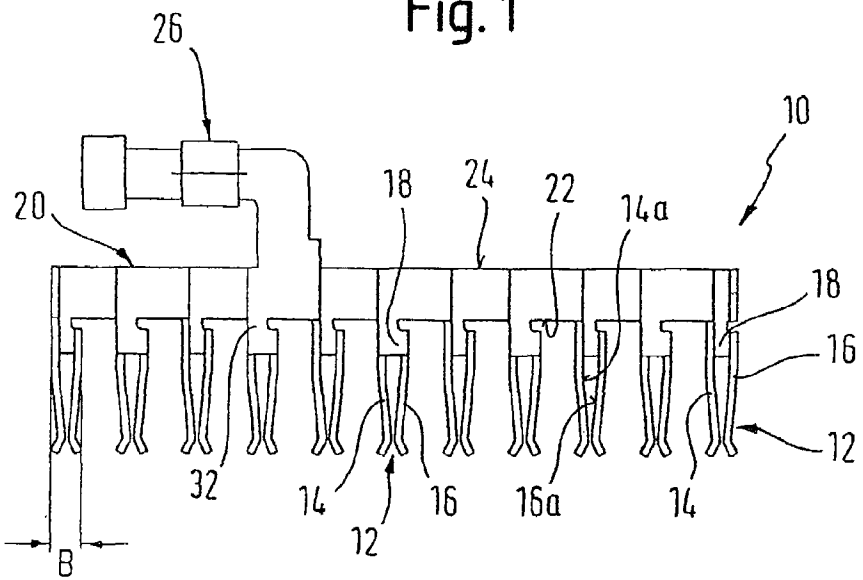
FIG. 1 is a front view of a current bridge in accordance with an embodiment of the present invention.
Figure 2:
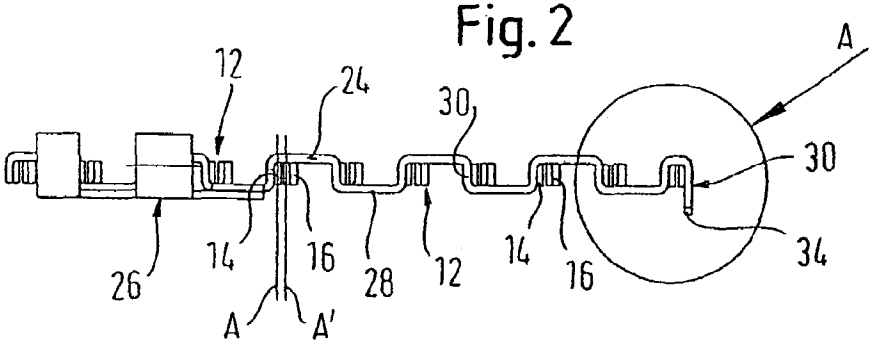
FIG. 2 is a top view of the current bridge of FIG. 1.

FIG. 1 depicts a side view of an embodiment of a current bridge 10. Current bridge 10 comprises a plurality of contact feet 12. Each of the feet has a first leg 14 and a second leg 16. In the illustrated embodiment, both the first leg 14 and the second leg 16 are designed as spring legs. The legs 14, 16 are formed integrally with a connecting portion 18 and the support strip 20. The main faces 14*a* and 16*a* of the strip-shaped legs 14, 16 face towards one another and extend substantially parallel to one another, as is shown in FIG. 1 and as is indicated in FIG. 2 by the two lines A and A'.

In one embodiment, the two legs 14, 16 are designed to make contact with one another in a lower portion by virtue of a low, elastic pre-tension in the legs. However, in other embodiments, there is contact without tension or even a slight gap between the legs when the current bridge is not connected to a mating component.

In one embodiment, the plurality of contact feet are arranged side by side on the support strip and are formed integrally with the support strip 20. The support strip 20 has a first end face 22 that faces towards the contact feet 12, and the support strip has a second end face 24 that is opposite the first end face 22.

In one embodiment, a crimp portion 26 that accepts leads with cross-section between 4 $mm^2$ and 6 $mm^2$ is provided on the second end face 24.

The contact feet can be arranged to emanate from the first end face 22 of the support strip 20. The support strip 20 may also have a meandering, cross sectional shape, as is shown in FIG. 2, which is a top view of the embodiment shown in FIG. 1 as viewed from the second end face 24 toward the first end face 22. FIG. 2 also illustrates an embodiment of the support strip 20 with an oblong shape (that, the support strip extends along a longitudinal axis, and is longer than it is wide). The meandering course of the support strip 20 forms first portions 28 that extend along the longitudinal axis of the support strip 20 and second portions 30 that extend transverse to the longitudinal axis. The second portion 30 may be formed as a continuous section with leg 14.

Figure 6:
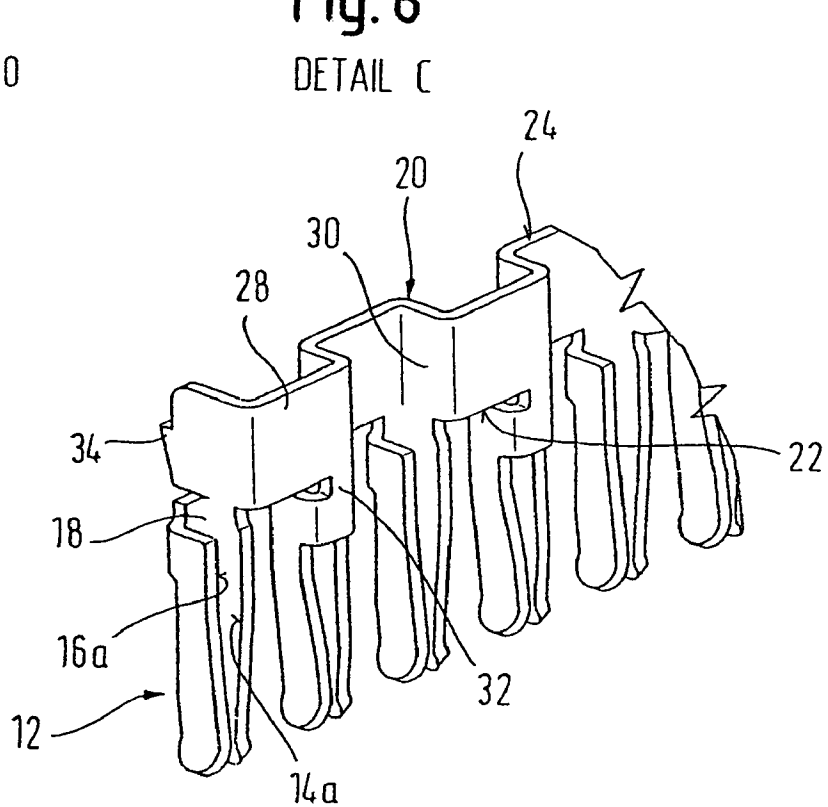
FIG. 6 is an enlarged view of a portion of the current bridge encircled by line C of FIG. 5.
Figure 5:
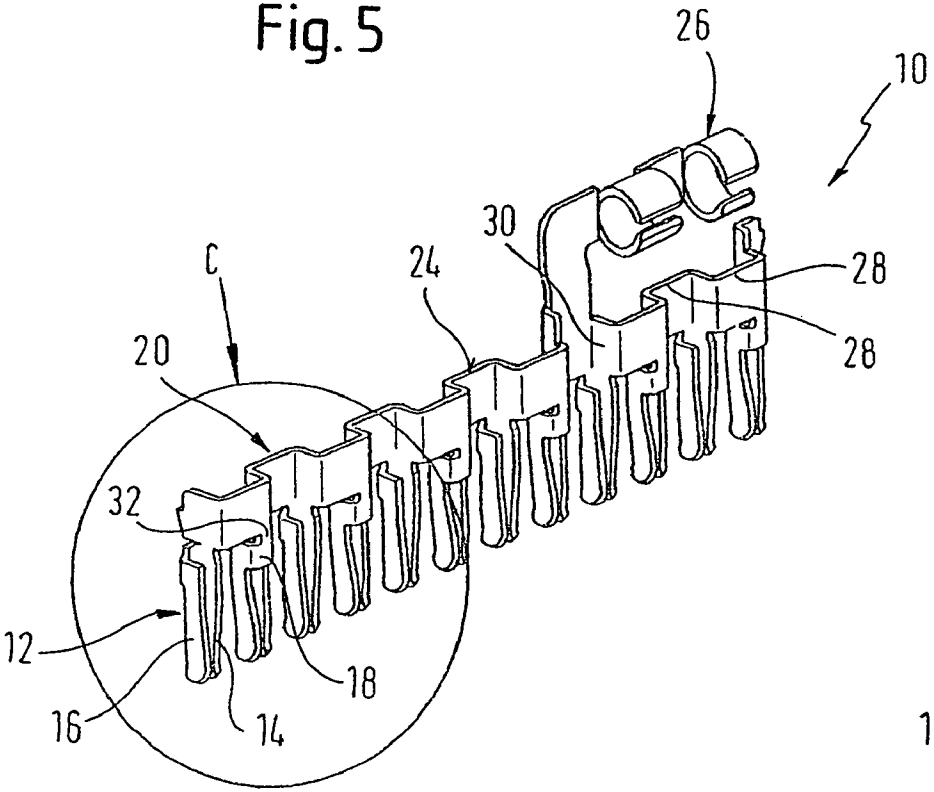
FIG. 5 shows a perspective view of the current bridge of FIG. 1 as viewed from an opposed side.

FIG. 1 also illustrates an embodiment with a connecting portion or portions 18 formed integrally, at least in part, with a first portion 28 of the oblong support strip 20. As shown in FIGS. 5 and 6, the first leg 14 of the contact feet 12 can be formed integrally, at least in part, with a second portion 30 of the oblong support strip 20. Here, it is possible to have a web width 32 that connects the contact feet 12 to the oblong support strip 20 with such a dimension that prevents or reduces the possibility that the contact feet 12 will twist or break off when the current bridge is installed within a housing or the like. Also, fusion of the web 32 may be prevented whenever there are high currents.

In an illustrative embodiment, the main faces of the legs 14 and 16 of each of the contact feet 12 are parallel to one another. The meandering, cross sectional shape of the oblong support strip 20 allows such parallel alignment and the sufficiently large connection to the oblong support strip 20 through the web 32. This meandering shape may also allow the geometry of the part to be formed through bending alone, such as through stamping. Here, all the components of the current bridge may formed together integrally from a metal sheet. In embodiments that do not have a meandering course, it may be possible to connect the contact feet 12 to the support strip 20 by a web 32 that is connected to the connecting portion 18, but not to each of the legs.

Figure 3:
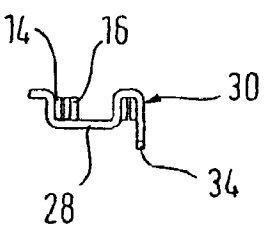
FIG. 3 is a view of a portion of the current bridge encircled by line A of FIG. 2.

FIGS. 3 and 4 show an embodiment with a catch 34 in the form of a catch lug at an end of a second portion 30. The catch 34 can hold the current bridge within a housing, such as by engaging with a catch recess in the housing. The catch 34 may be formed during the punching-out process of the current bridge, without entailing any additional processing steps for the current bridge. Other suitable techniques for forming the catch may be employed, as the present invention is not limited in this respect.

As is also shown in FIGS. 5 and 6, the metal sheet from which the current bridge 10 is made, can be bent through 180° in the region between the legs 14, 16 and connecting portion 18. That is, the two legs together with the connecting portion can form a U-shape, such that the contact feet essentially assume a U-shape in the upper region.

In one embodiment, the width dimension B of the individual contact feet 12 may be reduced while providing contact feet that are large enough to prevent or reduce the possibility of twisting, breaking off or fusing together of the feet. The meandering configuration of the oblong support strip may assist in achieving these effects. Also, the current bridges that have a meandering cross sectional shape may be formed from a single piece of sheet metal. Here, the current bridge is first punched out from sheet metal and is then bent into the corresponding geometry. The present invention therefore permits the width dimension of the contact feet 12 to be reduced, without adversely affecting the current bridge's manufacture from production or cost considerations.

Furthermore, the inventive current bridge can include a primary catching mechanism that is perpendicular to the longitudinal extension of the current bridge 10. The catching mechanism may also be formed when the current bridge is punched out of sheet metal.

In some embodiments, the current bridge is from copper-zinc alloy sheet metal. In one embodiment, the current bridge is made from a high-hardness copper-zinc alloy, such as CuZn30F44 (DIN 17670). However, other materials can also be used as aspects of the invention are not limited in this regard. This material of the current bridge can be tin-plated before material used to form the current bridge it is bent into the shape depicted in the drawings or even before the raw parts are punched out sheet metal to form the current bridge. However, the current bridge can be coated after the current bridge as well, or not at all, as the invention is not limited in this respect.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A current bridge made of sheet-metal, the current bridge comprising:

an oblong support strip having an end face; and a plurality of contact feet, each having a first strip-shaped leg and a second strip-shaped leg, at least one of the first and second legs being a spring leg, said contact feet extending from said end face of said support strip and being formed integrally with said support strip, wherein the first and second legs of each of the plurality of feet have a main face specified by their strip shape that extend essentially parallel to one another, wherein said support strip, when said end face of said support strip is viewed from above, comprises a meandering course having first portions that extend essentially in a longitudinal axis of said support strip and having second portions that extend essentially perpendicular to the longitudinal axis, wherein said first leg is connected integrally to at least part of said second portion and said second leg is connected to said first leg via a connecting portion, said connecting portion being connected integrally to at least part of said first portion of said support strip.

2. The current bridge of claim 1, wherein said first leg is an abutment leg and said second leg is a spring leg.

3. The current bridge of claim 1, wherein said first leg is a spring leg and said second leg is an abutment leg.

4. The current bridge of claim 1, wherein said first leg and said second leg are each a spring leg.

5. The current bridge of claim 1, wherein a catch is provided at one end of a second portion.

6. The current bridge of claim 5, wherein said catch is provided at only one end of said oblong support strip.

7. The current bridge of claim 1, wherein the sheet metal is made from a copper-zinc alloy.

8. The current bridge of claim 1, wherein said current bridge has a geometry that can be traced back to a planar stamped part.

9. The current bridge of claim 8, wherein said two legs of said contact feet are each arranged relative to one another such that said main surfaces of those regions which represent said two legs adapted to be disposed within a housing face towards one another.

10. The current bridge of claim 1, wherein said two legs are formed integrally together and the sheet metal has a bend of 180° between said two legs and said contact feet are substantially U-shaped.

11. The current bridge of claim 1, wherein an end face opposite to said end face of said support strip includes a crimp portion that is formed integrally with said support strip.

12. The current bridge of claim 1, wherein said spring leg has a length defined between said connection portion and a free end, said length being selected based on a location of said connection portion relative to the free end to define a resilience of the spring leg.

13. The current bridge of claim 1, wherein the first and second legs and each of the plurality of feet have a main surface that extend essentially parallel to one another and that face one another along the lengths thereof, with said surfaces being adapted to make electrical contact with a mating component.

* * * * *